US006337706B1

(12) United States Patent
Fujita

(10) Patent No.: US 6,337,706 B1
(45) Date of Patent: Jan. 8, 2002

(54) SOLID SCANNING OPTICAL WRITING DEVICE, LIGHT AMOUNT CORRECTION METHOD THEREFOR AND LIGHT AMOUNT MEASURING DEVICE

(75) Inventor: Atsushi Fujita, Kusatsu (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/496,251

(22) Filed: Feb. 2, 2000

(30) Foreign Application Priority Data

Feb. 5, 1999 (JP) ..... 11-029308

(51) Int. Cl.[7] ..... B41J 2/435; B41J 2/385

(52) U.S. Cl. ..... 347/236; 347/246; 347/136

(58) Field of Search ..... 347/236, 237, 347/246, 247, 136; 355/67, 68, 71; 359/323; 399/4; 349/62, 63, 199

(56) References Cited

U.S. PATENT DOCUMENTS 5,262,888 A 11/1993 Morishita et al. ..... 359/245
5,450,230 A 9/1995 Masuda et al. ..... 359/254
5,684,568 A * 11/1997 Ishikawa et al. ..... 355/68
5,790,240 A * 8/1998 Ishikawa et al. ..... 355/68
5,872,587 A 2/1999 Fujita et al. ..... 347/132

FOREIGN PATENT DOCUMENTS

JP 10-185684 * 7/1998 ..... B41J/2/44

* cited by examiner

*Primary Examiner*—Hai C. Pham
(74) *Attorney, Agent, or Firm*—Sidley Austin Brown & Wood

(57) ABSTRACT

A solid scanning optical writing device has multiple optical elements which are aligned in a zigzag fashion to form two lines in a main scanning direction. Each of the optical elements is turned ON/OFF in accordance with image data to write an image. In the solid scanning optical writing device, the amount of light output from each of optical elements is corrected based on correction data. The correction data is obtained by detecting light amount distribution of each of the two lines and obtaining ridge light amount and trough light amount from the detected light amount distributions.

15 Claims, 6 Drawing Sheets

SOLID SCANNING OPTICAL WRITING DEVICE, LIGHT AMOUNT CORRECTION METHOD THEREFOR AND LIGHT AMOUNT MEASURING DEVICE

This application is based on an application No. 11-29308 filed in Japan, the contents of which is hereby incorporated by reference.

BACKGROUND OF THE INVENTION

1. Field of the Invention

The present invention pertains to a solid scanning optical writing device to write images using a PLZT light shutter array or LED array, light amount correction method therefor and light amount measuring device.

2. Description of the Related Art

Various optical writing devices have conventionally been provided that form images on photographic paper or film using a silver halide material, or on an electrophotographic photoreceptor, by controlling the light for each pixel using a light shutter array or LED array comprising PLZT or other elements. In such an optical writing device, line noise may occur in the output image due to a variation in the amount of light passing through or emitted from the optical elements of the light shutter array or LED array. In order to eliminate this noise, the light amount output from each optical element is measured, correction calculation is performed based on the measurement results, and correction of the light amount variation (shading correction) is performed.

In measuring the light amount, it is preferable from the standpoint of ensuring measurement accuracy and making the measuring device small in size that the light amount from each optical element of the light shutter array, etc., be directly measured. However, it is not easy to accurately measure the light amount from each of the optical elements, which have an extremely dense arrangement in order to form high resolution images, and correlate the measurement results to each optical element.

FIGS. 8 and 9 show how light amount measurement is conventionally performed. They show how the amount of light that passes through each light shutter 31 (optical element) of the PLZT light shutter array is measured by means of a measuring device. The multiple light shutters 31 are aligned in two lines. A light shutter 31 of one line is located between two light shutters 31 of the other line. When voltage is impressed, the light shutter 31 causes the plane of polarization of the light that entered it from behind to rotate, allows the light to pass through and outputs it from the front. When voltage is not impressed, the plane of polarization of the light that enters the light shutter 31 from behind does not rotate and the light is output from the front just as it struck the light shutter. 91 indicates a light receiving mask located in front of the sensor that receives the light from the light shutters 31. In FIG. 8, the light receiving mask 91 has a slit 91*a* with the same configuration as the light shutter 31, and regulates the light that strikes the sensor. The light receiving mask 92 shown in FIG. 9 has a slit 92*a*, the length of which that runs along the secondary scanning direction perpendicular to the length of the lines of the light shutter is equal to the length of the light shutter 31. When the amount of light passing through the light shutter 31 is measured using such a mask 91 or 92, the light amount output from each light shutter 31 may be accurately measured.

However, when a light shutter array is actually used as an optical writing device, from the standpoint of efficiency of use of the light, and to ensure that the necessary distance from the exposure surface is maintained, an image forming lens (selfoc lens array) is often used together with the light shutter array. FIG. 10 is a view of the positional relationship between a selfoc lens array and the light shutters 31 of a PLZT light shutter array. Ordinarily, due to the effect of the selfoc lens array on the image forming resolution (hereinafter 'MTF'), the output light from the light shutters 31 is slightly blurred when it forms an image on the exposure surface.

Because a selfoc lens array comprises multiple rod lenses 35*a* aligned in a zigzag fashion, as shown in FIG. 10, the MTF varies depending on the positional relationship between the light shutters 31 and the rod lenses 35*a*. In other words, the image formed on the exposure surface by the output light from the light shutters 31 may be sharp or blurry depending on the area. Where light is output from both lines of the light shutters 31, the light amount from the gap between light shutters 31 (trough light amount) does not become completely zero. As explained above, where the light shutters 31 are aligned in a zigzag fashion such that they form two lines, exposure is performed by means of the light from a particular light shutter 31, to which some of the light from the neighboring light shutters 31 located in the other line is added.

In addition, in the manufacturing process by which the light shutters 31 are aligned in a zigzag fashion such that they form two lines, a groove 32 (see FIGS. 8 and 9) is formed between any two light shutters 31, and a slight amount of light escapes of this groove 32. This escaping light affects the actual exposure as well.

Due to the details explained above, correcting the variation in light amount among the optical elements simply based on the information on the light amount measured using the mask 91 or 92 shown in FIG. 8 or 9 is insufficient to correct the variation in light amount on the exposure surface where an image is actually formed, and a variation in light amount still occurs on the exposure surface.

OBJECTS AND SUMMARY

The object of the present invention is to provide an improved solid scanning optical writing device, light amount correction method therefor and light amount measuring device.

Another object of the present invention is to provide a solid scanning optical writing device, light amount correction method therefor and light amount measuring device that are capable of accurately measuring the output light amount of each optical element and performing good light amount correction.

Yet another object of the present invention is to provide a solid scanning optical writing device, light amount correction method therefor and light amount measuring device in which the variation in light amount among the optical elements is corrected on the exposure surface where an image is formed.

In order to attain these and other objects, one aspect of the present invention comprises a solid scanning optical writing device that, based on the image data, turns ON/OFF the multiple optical elements that are aligned in a zigzag fashion such that they form two lines in the main scanning directions, said optical writing device having a light amount measuring unit including a light amount sensor to measure the amount of light output from the optical elements, wherein the light receiving area of the light amount sensor has an open slit and the length of the opening of the slit in the secondary scanning direction is set to be as long as or longer than the length of the optical element in the secondary scanning direction.

Another aspect of the present invention comprises a light amount measuring device having a light amount measuring unit including a light amount sensor to measure the amount of light output from the multiple optical elements aligned in a zigzag fashion such that they form two lines, a means to move the light amount measuring unit forward and backward in the direction of the alignment of the optical elements, and a means to adjust the position of the light amount measuring unit, wherein the light receiving area of the light amount sensor of the light amount measuring unit has an open slit and the length of the opening of the slit in the direction perpendicular to the direction of the alignment of the optical elements is set to be as long as or longer than the length of the optical element.

Yet another aspect of the present invention comprises a light amount correction method for the solid scanning optical writing device, wherein this method turns ON/OFF the multiple optical elements aligned in a zigzag fashion such that they form two lines in the main scanning directions based on the image data, and has (i) a process in which only the optical elements in one of the two lines are caused to illuminate and the amount of light output from the optical elements of this line is measured while the light amount measuring unit is caused to be moving in the main scanning directions, (ii) a process in which only the optical elements in the other line are caused to illuminate and the amount of light output from the optical elements of this line is measured while the light amount measuring unit is caused to be moving in the main scanning directions, and (iii) a process in which the correction amount regarding the amount of light output from each optical element is calculated from the ridge light amount of the optical element and the trough light amount from the space located at the same position as the optical element but in the other line.

Using the construction described above, because not only the ridge light amount (the maximum light amount) of the optical element but also the trough light amount (the light amount from between two optical elements) of the space located at the same position as the optical element but in the other line is added into the calculation, the amount of light output from each optical element may be measured with accuracy, making it possible to obtain highly accurate shading correction (light amount variation correction).

In addition, by making the length of the opening of the slit of the light amount sensor light receiving area in the secondary scanning direction sufficient to cover the two lines of optical elements aligned in a zigzag fashion, the amount of light escaping from the groove between any two optical elements may be detected, making the light amount correction more accurate.

Further, in the process in which the amount of correction of the optical element output light amount is calculated, by calculating the optical resolution per unit length from the alignment pitch of the optical elements and calculating the amount of correction regarding the optical element output light amount using this optical resolution, the trough light amount (the light amount from between two optical elements) when the ridge amount (the maximum light amount) for the optical element changes is calculated, making better light amount correction possible.

BRIEF DESCRIPTION OF THE DRAWINGS

These and other objects and features of the present invention will become apparent from the following description of a preferred embodiments thereof taken in conjunction with the accompanying drawings, in which.

In the following description, like parts are designated by like reference numbers throughout the several drawing.

DETAILED DESCRIPTION OF THE PREFERRED EMBODIMENTS

Embodiments of the solid scanning optical writing device, light amount correction method therefor and light amount measuring device are explained below with reference to the accompanying drawings.

[Optical Writing Head]

Figure 1:
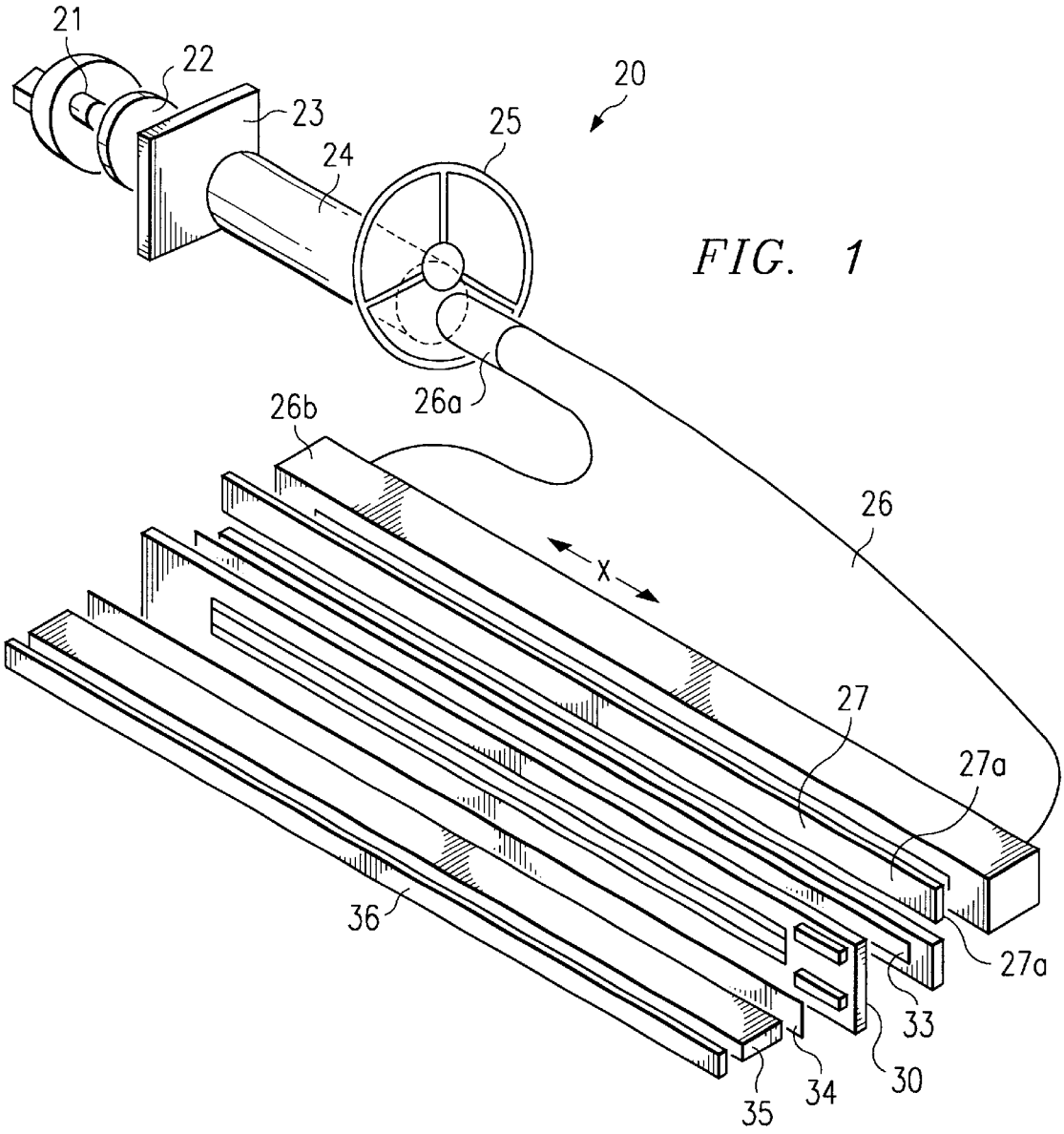
FIG. 1 is a perspective view of the optical writing device.

FIG. 1 shows an optical writing head 20 to write color images on photographic paper using a silver halide material. This optical writing head 20 essentially comprises a halogen lamp 21, a heat-absorbing filter 22, a color correction filter 23, a diffusion cylinder 24, an RGB filter 25, an optical fiber array 26, a slit plate 27, a light shutter module 30, an image forming lens array (selfoc lens array) 35 and a dustproof glass panel 36.

The light emitted from the halogen lamp 21 is deprived of heat by the heat-absorbing filter 22 and is adjusted by the color correction filter 23 so that the light quality can match the spectral-response characteristic of the photographic paper. The diffusion cylinder 24 improves the light use efficiency and reduces the unevenness in light amount. The RGB filter 25 is driven to rotate in synchronization with the writing performed by the light shutter module 30, described below, and changes the color of the passing light for each line.

The optical fiber array 26 comprises a large number of optical fibers. The ends 26*a* are bound together and face the diffusion cylinder 24 via the RGB filter 25. The other ends 26*b* are aligned in the main scanning directions indicated by the two-headed arrow X and emit light in a linear fashion. The slit surfaces 27*a* of the slit plate 27 have a smooth finish to efficiently lead the light emitted from the optical fiber array 26 to the light shutter module 30. The slit plate 27 also has a heater (not shown in the drawing) to maintain the PLZT shutter chips at a constant temperature, and temperature control is performed based on the detection results from a temperature detecting element (not shown in the drawing) mounted on the module 30.

The light shutter module 30 comprises multiple light shutter chips, which comprise PLZT shutters, aligned to form an array in a slit opening in a ceramic substrate or in a glass substrate, as well as driver ICs mounted along the array. The multiple light shutters 31 formed on each light shutter chip are aligned in two lines extending in the main scanning directions (X). Along these lines, one light shutter 31 in one line is located between two light shutters 31 in the other line (see FIG. 3). In other words, the light shutters 31 are aligned in a zigzag fashion such that they form two lines. Each light shutter 31 is independently driven by its driver IC based on the image data. A polarizer 33 and an analyzer 34 are mounted in the front and back of the module 30, respectively. PLZT is a ceramic material having a light permeability with a large Kerr constant electro-optical effect, as is well known. The light that strikes the light shutters 31 is linearly polarized when passing through the polarizer 33 before striking the light shutters 31. The light that strikes a light shutter 31 undergoes rotation of the plane of polarization when a voltage is impressed to the light shutter 31, and is thereby emitted from the light shutter 31 toward the analyzer 34. When no voltage is impressed to the light shutter 31, the light that enters the light shutter 31 does not undergo rotation of the plane of polarization, and is emitted just as it struck the light shutter. The analyzer 34 located behind the light shutters 31 allows the light that has undergone rotation of the plane of polarization to pass by means of the light shutters 31 and blocks the light that has not undergone rotation of the plane of polarization. In other words, in the ON state in which a voltage is impressed to the light shutter 31, the light is emitted through the analyzer 34, and in the OFF state where no voltage is impressed, the light is not emitted through the analyzer 34.

The light emitted through the analyzer 34 passes through the image forming lens array 35 and the dustproof glass panel 36 and forms an image on the photographic paper, forming a latent image. The photographic paper is conveyed at a constant speed in a direction perpendicular to the main scanning directions (X) (the secondary scanning direction).

[Light Amount Measuring Device and Measuring Method]

Figure 2:
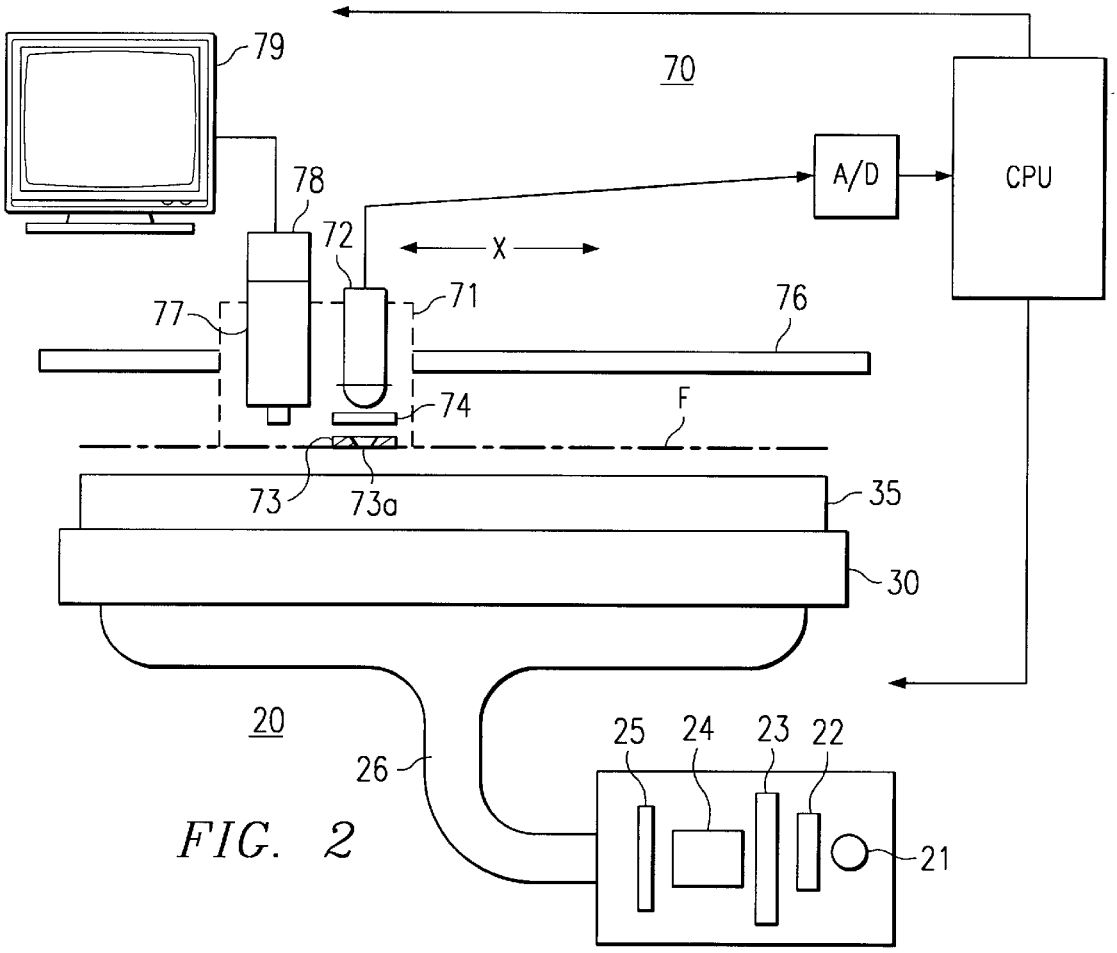
FIG. 2 is a plan view showing the basic construction of the light amount measuring device.

FIG. 2 shows a measuring device 70 that measures the amount of light from each light shutter of the optical writing head 20.

This measuring device 70 comprises a measuring unit 71 having a light amount sensor 72 and a tool microscope 77, which is mounted to a guide rod 76, such that the measuring unit can slide along the guide rod. The guide rod 76 is located parallel to the main scanning directions of the light shutter module 30 (the directions of the two-headed arrow X), so that the measuring unit 71 moves forward and backward at a constant speed in the directions of the two-headed arrow X while the light amount sensor 72 is positioned immediately above the light shutters 31. The light amount sensor 72 measures the amount of light output from the light shutters 31.

A light receiving mask 73 and a light diffusion plate 74 are located on the light entry side of the light sensor 72. The light receiving mask 73 has an open slit 73*a*. This open slit 73*a* is designed such that its opening width in the main scanning directions (X) is essentially the same as the width of the light shutter 31 in the main scanning directions (X) and the opening length in the secondary scanning direction is as long as or longer than the length of the light shutter 31 in the secondary scanning direction. In this embodiment, the opening length of the open slit 73*a* in the secondary scanning direction is long enough to cover light shutters 31 in the two lines (see FIG. 3). By having this length in the open slit 73*a*, the leak light amount from the groove between two light shutters 31 may be detected, enabling more accurate light amount correction. The light receiving mask 73 is located on the focusing plane F of the image forming lens array 35. For the light amount sensor 72, a sensor having a spectral-response characteristic range that is equal to or larger than that of the photographic paper, the recording medium, is used.

The tool microscope 77 is mounted as an integrated unit with the CCD camera 78. The image of the light shutters is taken by means of the CCD camera 78 via the tool microscope 77 and displayed on a monitor 79. The operator performs fine adjustment (focusing and position adjustment) of the position of the optical writing head 20 at both ends of the light shutters while viewing the image on the monitor 79. In other words, the optical writing head 20 is mounted by means of a mounting platform not shown in the drawing such that it may be adjusted in terms of height, angle and distance from the light amount sensor 72. When the device is shipped from the factory, the tool microscope 77, CCD camera 78 and monitor 79 are usually removed.

The light amount measuring device 70 and optical writing head 20 having the construction described above are controlled by a microcomputer CPU, so that the timing for the forward and backward movement of the measuring unit 71 and light amount measurement is controlled. The optical writing head 20 is driven using pre-programmed drive parameters, which include drive frequency and ON duty. Drive frequency is the frequency of the voltage that is impressed to the light shutters 31, and ON duty is the period in which the voltage is impressed in one cycle. The measuring device 70 samples the light amount of each light shutter in synchronization with this driving. Normally, sampling of the light amount is performed multiple times per element due to the relationship between the drive frequency and the drive speed of the light amount sensor 72. The output from the light amount sensor 72 undergoes A/D conversion, and the converted data is transferred to the microcomputer CPU for necessary processing.

Figure 4:
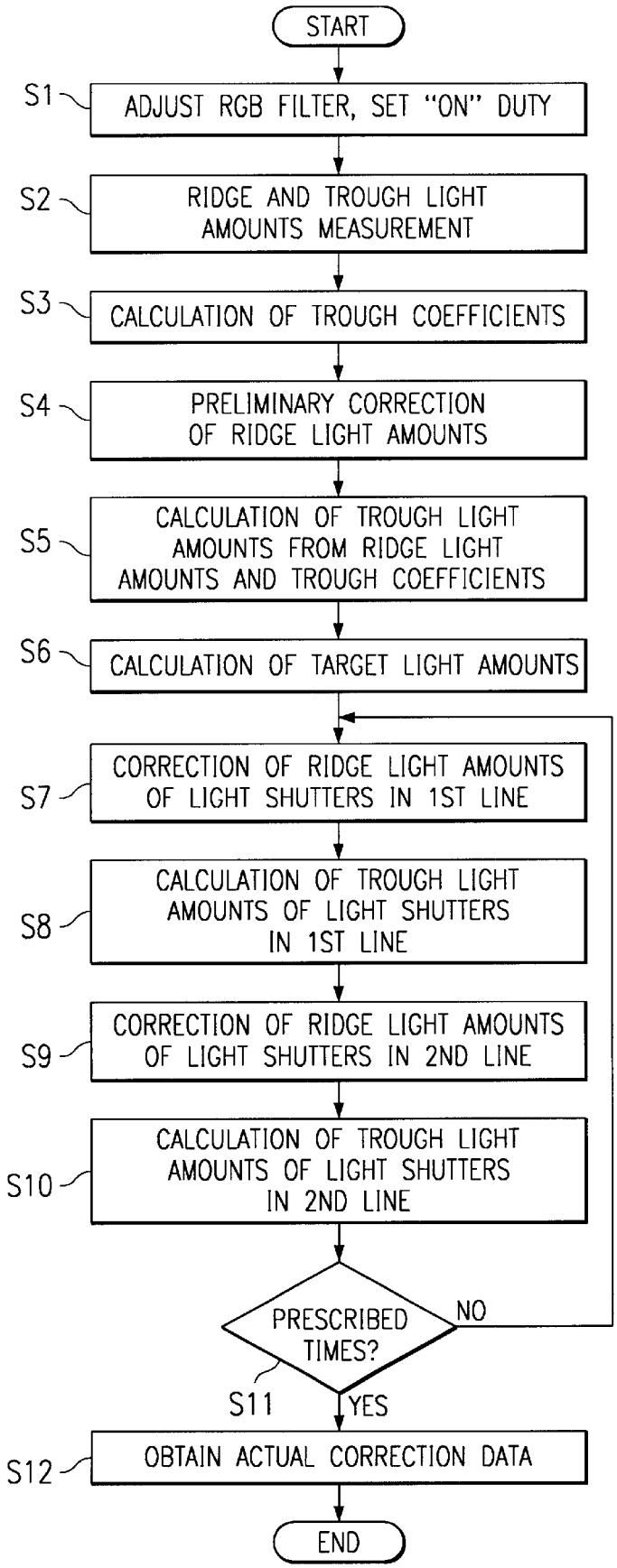
FIG. 4 is a flow chart showing the correction algorithm for light amount variation during light amount measurement.

The light amount correction method will now be explained with reference with FIG. 4.

Figure 3:
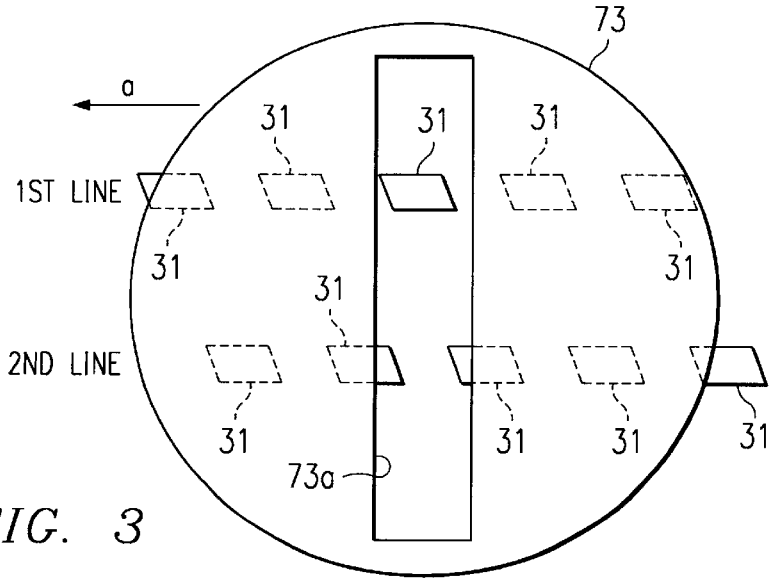
FIG. 3 is a front elevation showing the configuration of the light receiving area of the light amount sensor.

Control regarding light amount correction is carried out by the microcomputer CPU in response to the turning ON of power to the printer. In step S1, the RGB filter 25 is adjusted to bring up the prescribed color, and the ON duty is set to the prescribed value. In step S2, the light shutters 31 of one line only are driven using the ON duty thus set. In this embodiment, voltage is impressed for the maximum time per cycle, i.e., at all times, and light is emitted from the entire optical writing head 20. With the optical writing head 20 in this state, the light amount sensor 72 is moved forward from the initial position outside the scanning range of the light shutters 31. When this occurs, as shown in FIG. 3, the light receiving mask 73 moves in a straight line in the direction of the arrow (a) as the light amount sensor 72 moves forward. An area of the first line of light shutters 31 and an area of the second line appear simultaneously inside the open slit 73*a*. After moving the light amount sensor 72 over a distance slightly longer than the main scanning length, sampling of the light amount data for the light shutters 31 of the first line is stopped and the light amount sensor 72 is moved backward to the initial position.

After the light shutters 31 of the first line are turned OFF, the light shutters 31 of the second line are driven using the same parameters as for the first line to measure the light amount of the light shutters 31 of the second line and to incorporate the data. After this process is finished, light amount measurement regarding all light shutters 31 is completed. Naturally, it is acceptable if light amount measurement regarding the light shutters 31 of the second line is performed when the light amount sensor 72 is moved backward, which is more efficient.

Figure 5:
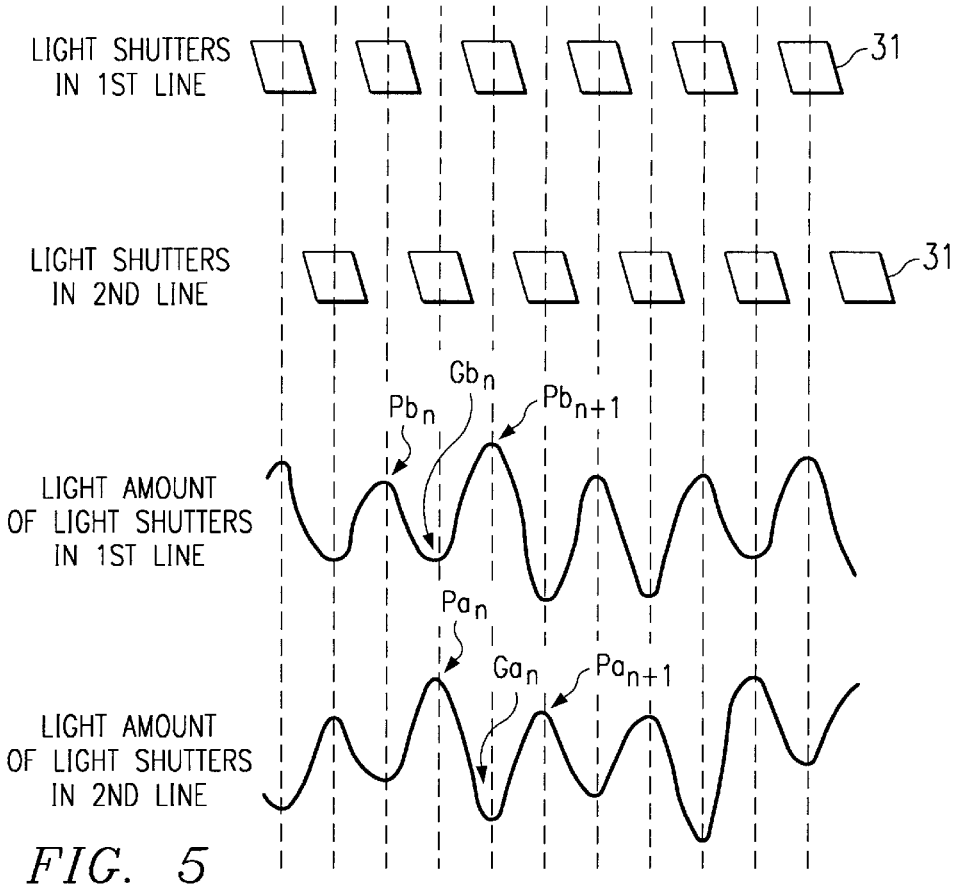
FIG. 5 is a light amount distribution chart showing the change in the light passing through the optical element when measurement is made while moving the light amount sensor for each line of optical elements.

FIG. 5 shows the change in sampled light amount for each line thus obtained. Since the slit 73*a* having a width that is essentially the same as the width of the light shutter 31 in the main scanning directions (X) is moved in the main scanning directions (X) during light measurement, the maximum light amount (ridge light amount) is reached when the light amount sensor 72 faces a light shutter 31, and the minimum light amount (trough light amount) is reached when the light amount sensor 72 is between two light shutters 31. Consequently, by detecting the peaks of the output light amount, the positions (addresses) of the light shutters 31 may be identified. The positions of the minimum light amount points between light shutters 31 may be identified by detecting the opposite peaks in the same manner as for the maximum light amount points, but instead, the point in the middle between two maximum light amount points may be deemed a minimum light amount point.

In step S3, the nth trough coefficients for the first line and for the second line (Kbn, Kan, respectively) defined by the following equations (1) and (2) are then calculated.

The nth trough coefficient for the first line:

$$Kbn=Gbn/(Pbn+Pbn+1) \quad (1)$$

The nth trough coefficient for the second line:

$$Kan=Gan/(Pan+Pan+1) \quad (2)$$

Where

Gbn: the nth trough light amount in the first line

Gan: the nth trough light amount in the second line

Pbn: the ridge light amount of the nth light shutter in the first line

Pan: the ridge light amount of the nth light shutter in the second line

These trough coefficients Kbn and Kan are calculated in order to calculate the trough light amounts Gbn and Gan when the ridge light amounts Pbn and Pbn+1, Pan and Pan+1 of the neighboring light shutters 31 change, and are equivalent to the optical resolution (MTF) per unit length derived from the alignment pitch of the light shutters 31.

In step S4, preliminary correction is performed so that the ridge light amounts Pbn and Pan of the light shutters 31 in the first and second lines, respectively, may become located on standard lines and the ridge light amounts Pbn and Pan may become the same. In step S5, the trough light amounts Gbn and Gan are calculated from the ridge light amounts Pbn and Pan of the aligned light shutters 31 and the trough coefficients Kbn and Kan, respectively. In step S6, for each light shutter 31 in the first and second lines, the ridge light amount Pbn (Pan) of the light shutter 31 is added to the trough light amount Gan (Gbn) from the space that located is at the same position as the light shutter 31 but in the other line. Specifically, the following equations (3) and (4) are calculated.

Light amount of the nth light shutter in the first line:

$$(Pbn+Gan\times\alpha)\times\beta \quad (3)$$

Light amount of the nth light shutter in the second line:

$$(Pan+Gbn\times\alpha)\times\beta \quad (4)$$

Here, $\alpha$ and $\beta$ are parameters that are dependent on the image forming lens array 35, $\alpha$ being a trough addition coefficient and $\beta$ being a dark light amount threshold value.

The average value of the light amount regarding all light shutters 31 thus obtained is calculated and is deemed the target light amount T.

In step S7, while the trough light amount Gan for the nth light shutter 31 in the second line is left alone, the ridge light amount Pbn for the nth light shutter 31 in the first line is corrected. In other words, Pbn is adjusted such that T=Pbn+Gan is achieved. After this adjustment, the trough light amount Gbn in the first line is re-calculated from the trough coefficient Kbn and the corrected ridge light amount Pbn for the first line. Further in step S9, while the trough light amount Gbn for the nth light shutter 31 in the first line is left alone, the ridge light amount Pan for the nth light shutter 31 in the second line is corrected. In other words, Pan is adjusted such that T=Pan+Gbn is achieved. After this adjustment, the trough light amount Gan in the second line is re-calculated from the trough coefficient Kan and the corrected ridge light amount Pan for the second line in step S10.

In step S11, it is determined whether or not the steps of S7 through S10 have been repeated prescribed times, and if they have not been repeated prescribed times, step S7 is returned to. Conversely, if they have been repeated a prescribed number of times, actual correction data to realize the light amount distribution narrowed down by repeating the calculation in steps S7 through S10 is obtained in step S12 by referring to a basic light amount correction table. Good light amount correction is made possible in this fashion.

Figure 6A:
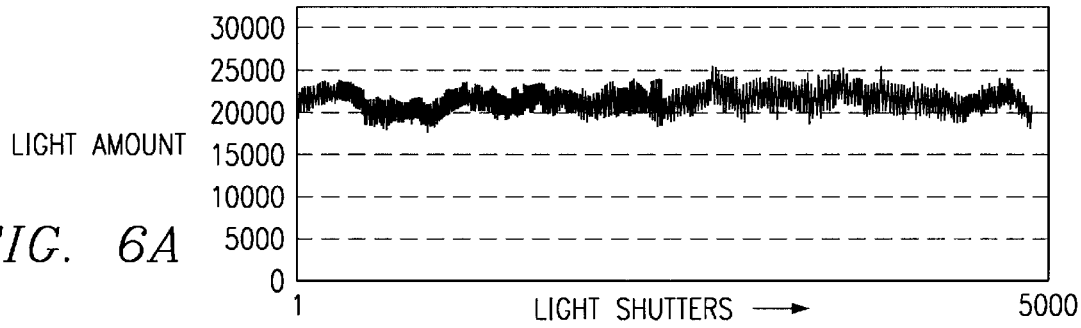
FIGS. 6(A), 6(B) and 6(C) are graphs showing the distribution of light amount measured by the optical writing device.
Figure 6B:
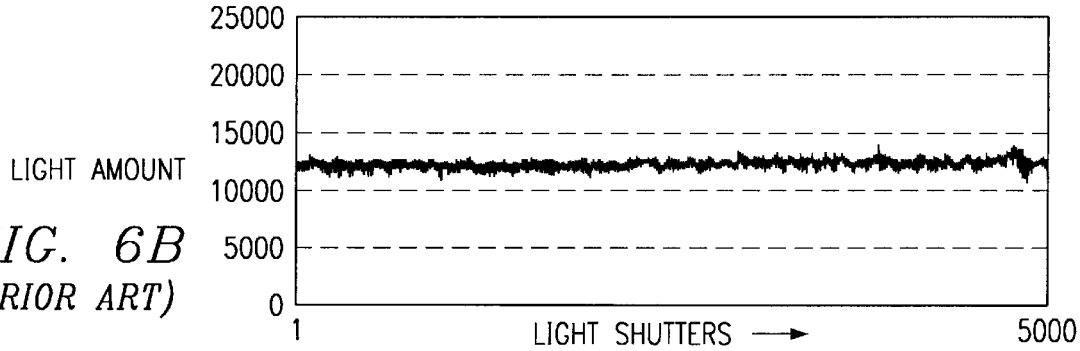
FIG. 6B (PRIOR ART)
Figure 6C:
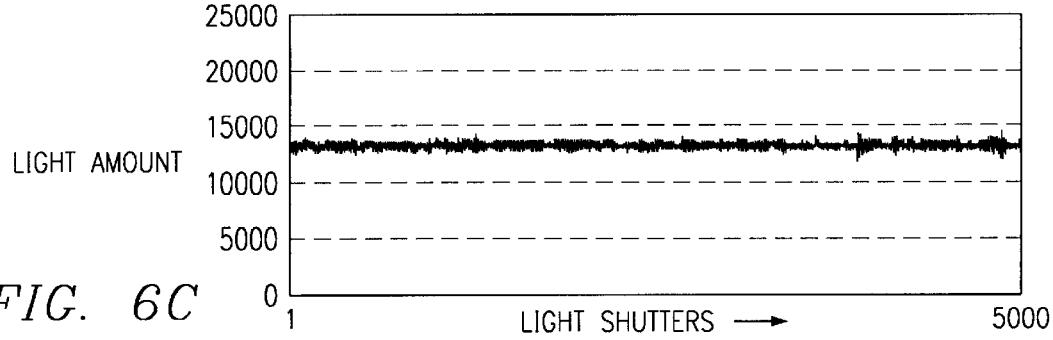

FIG. 6(C) is a light amount distribution chart regarding the optical writing head 20 after light amount correction is performed in accordance with the present invention. For comparison purposes, FIG. 6(A) is a light amount distribution chart regarding the optical writing head 20 before the correction, and FIG. 6(B) is a light amount distribution chart regarding the optical writing head 20 after light amount correction is performed using the conventional method.

[Color Printer]

Figure 7:
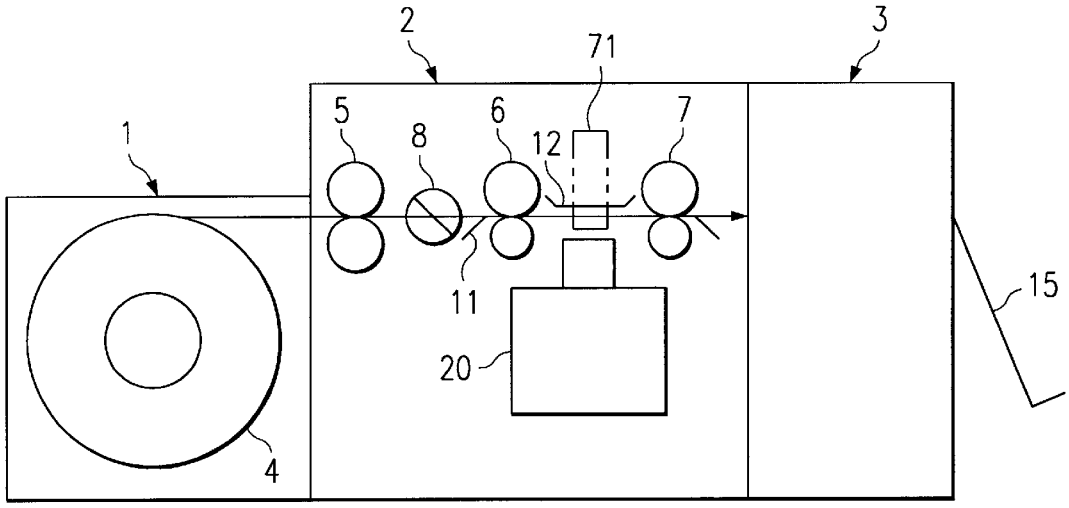
FIG. 7 is a view of the basic construction of a color printer in which the optical writing device is mounted.
Figure 8:
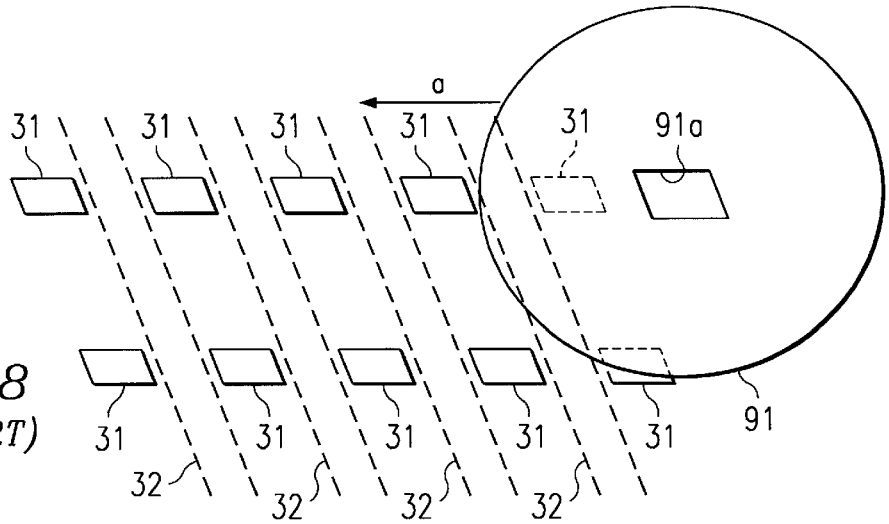
FIG. 8 (PRIOR ART)
FIG. 8 is a front elevation showing the configuration of the light receiving area of a conventional light amount sensor.
Figure 9:
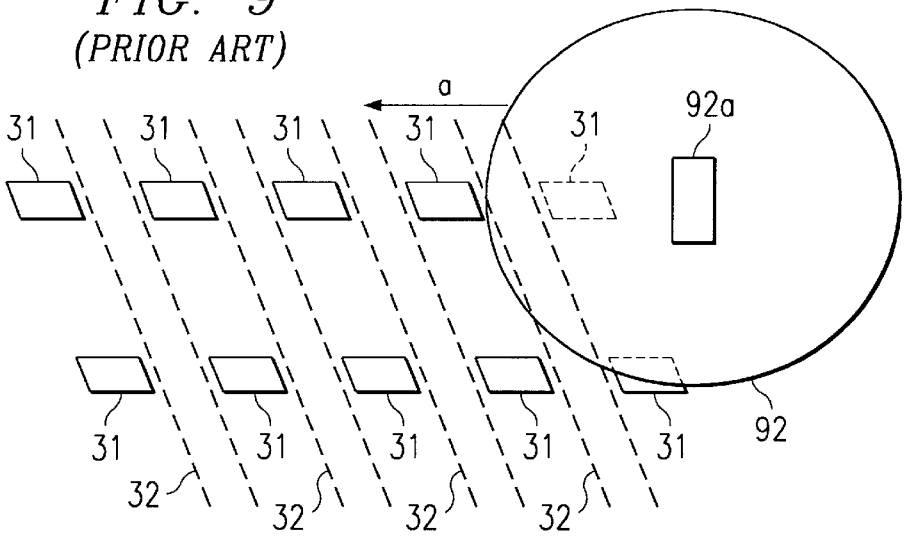
FIG. 9 (PRIOR ART)
FIG. 9 is a front elevation showing the configuration of the light receiving area of another conventional light amount sensor.
Figure 10:
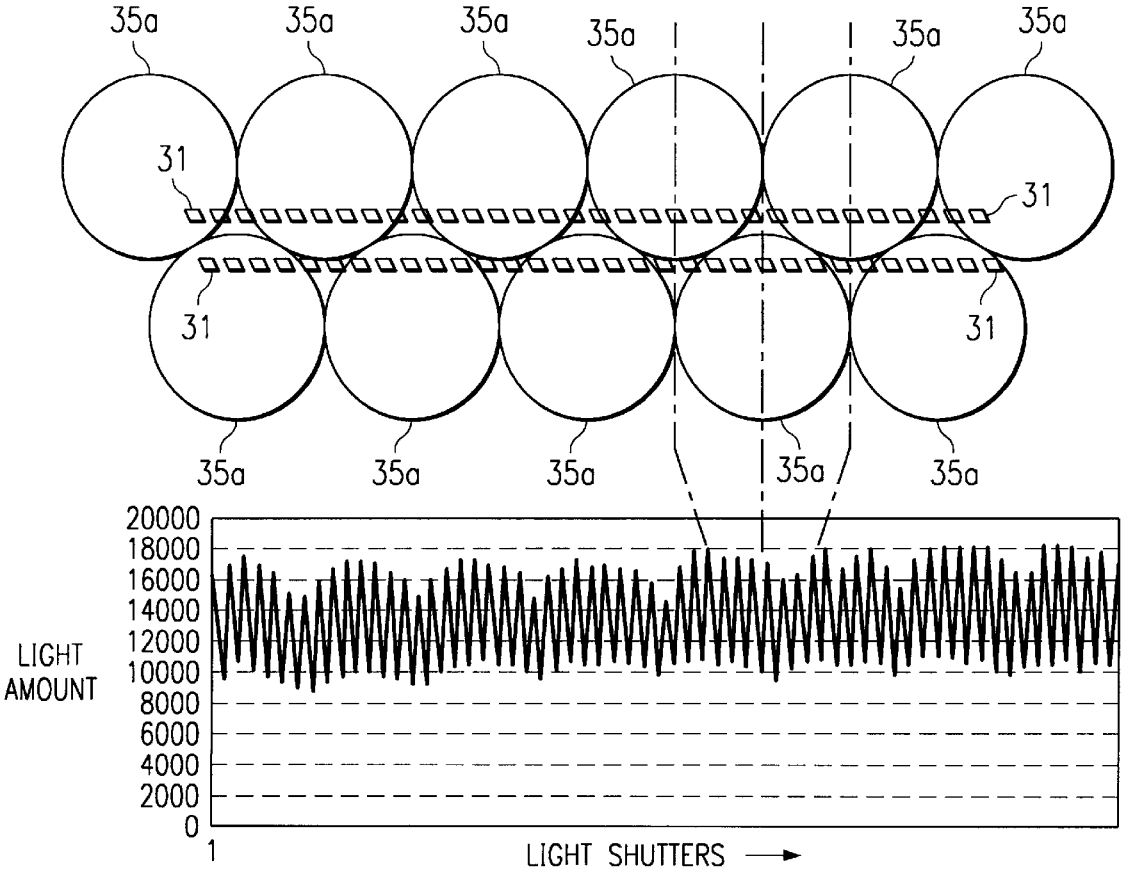
FIG. 10 is a view of the relationship between a selfoc lens array and the optical elements of a PLZT light shutter array.

FIG. 7 shows the basic construction of a color printer to produce photo prints. This color printer comprises a photographic paper storage unit 1, an image forming unit 2 and a processing unit 3. The photographic paper 4 is stored rolled up in the storage unit 1. In the image forming unit 2 are mounted an optical writing head 20 shown in FIG. 1 and a measuring unit 71 shown in FIG. 2 (the tool microscope 77, CCD camera 78 and monitor 79 are removed, however). Further, in the image forming unit 2 are also mounted conveyance roller pairs 5, 6 and 7 for the photographic paper 4, a cutter 8 and conveyance guide plates 11 and 12.

The photographic paper 4 is guided into the image forming unit 2 from the conveyance roller pair 5 with the photosensitive surface facing downward. When a certain length of the photographic paper 4 has been introduced, the rotation of the roller pair 5 is stopped and the cutter 8 is operated to cut the paper. The cut-off photographic paper segment 4 is conveyed at a constant speed by the roller pairs 6 and 7. When the photographic paper segment 4 passes the optical writing head 20, it is exposed through the opening formed in the guide plate 11, and an image (latent image) is formed on it. The photographic paper segment 4 is developed and dried in the processing unit 3 after exposure, and is then ejected onto the tray 15.

In this color printer, R, B and G images are written by rapidly changing the light source color through the rotation of the RGB filter 25 of the optical writing head 20 and by turning ON/OFF the PLZT light shutters for each line. In this printer, power is turned ON by means of a timer and temperature control for the developer is performed. During this warm-up period, light amount measurement regarding the light shutters and light amount correction (calibration) is performed. Calibration is the process, as described above, in which the optical writing head 20 is driven using essentially the same parameters as for the exposure to perform light amount correction based on the output light amount results. Through this process, images with a good quality gradation exhibiting no unevenness may be obtained. Light amount measurement and correction may be performed at any given time other than during warm-up of the printer.

OTHER EMBODIMENTS

The solid scanning optical writing device, light amount correction method therefor and light amount measuring device pertaining to the present invention are not limited to the embodiments described above, and may be modified in various ways within their essential scope.

In particular, for the optical elements used in the solid scanning optical writing device, LED (light emitting diode), LCS (liquid crystal shutters), DMD (deformable mirror devices) or FLD (fluorescent devices) may be used in addition to PLZT shutters.

In addition, while this embodiment is explained using a situation in which the unevenness in light amount is corrected based on measurement of mono-color single gradation output, in order to further increase the accuracy of correction, measurement data may be obtained based on multiple different light amount outputs (multiple gradation) by changing the illumination duty for the light shutters, or measurement may be performed for all light source colors (R, G and B).

In addition, the present invention may be applied in an image writing device that writes images onto silver halide film or an electrophotographic photoreceptor, or in an image projector that projects images onto a display, as well as in an image writing device that writes images onto photographic paper using a silver halide material.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A solid scanning optical writing device comprising:

multiple optical elements which are aligned in a zigzag fashion to form two lines in a main scanning direction, each of said elements being controllable based on image data to write an image;

a light amount measuring unit including:

a light amount sensor to measure an amount of light outputted by said optical elements, and an open slit which defines an area of said light amount sensor for receiving light from at least one element of said multiple optical elements and which has a length that is at least as long as a length of said at least one optical element in a secondary scanning direction perpendicular to the main scanning direction; and a light amount processor for determining a light correction amount based at least in part on a ridge light amount and a trough light amount of light output from said at least one optical element.

2. A solid scanning optical writing device as claimed in claim 1, wherein the length of said open slit is sufficient to cover the two lines of said optical elements.

3. A solid scanning optical writing device as claimed in claim 1, further comprising a mechanism for moving said light amount measuring unit forwardly and backwardly along the alignment of the optical elements.

4. A solid scanning optical writing device as claimed in claim 1, wherein the ridge light amount and the trough light amount are from a space located at the same position as a corresponding optical element but in opposite lines.

5. A solid scanning optical writing device as claimed in claim 1, wherein the light correction amount is further based at least in part on an optical resolution per unit length calculated from an alignment pitch of the optical elements.

6. A light amount correction method for use in a solid scanning optical writing device which, based on image data, controls each of multiple optical elements aligned in a zigzag fashion such that the optical elements form two lines in a main scanning direction, said method comprising:

a first step of causing only the optical elements in one of the two lines to illuminate and measuring distribution of amount of light output from the optical elements of said one line with respect to the main scanning direction;

a second step of causing the optical elements in the other line to illuminate and measuring distribution of amount of light output from the optical elements of said other line with respect to the main scanning direction; and a third step of calculating a correction amount regarding the amount of light output from each of said multiple optical elements based on a ridge light amount and a trough light amount of the distributions obtained by said first and second steps.

7. A light amount correction method as claimed in claim 6, wherein said correction amount for each of said optical elements is calculated based on the corresponding ridge light amount and the trough light amount from a space located at the same position as the optical element but in the other line.

8. A light amount correction method as claimed in claim 6, wherein said third step includes a step of calculating an optical resolution per unit length from an alignment pitch of the optical elements and a step of calculating the correction amount regarding the optical element output light amount using this optical resolution.

9. A light amount correcting device comprising:

a light amount measuring device for measuring an amount of light from a plurality of positions with respect to multiple optical elements aligned in a zigzag fashion such that the optical elements form two lines; and a light amount processor for determining a light correction amount based at least in part on a ridge light amount and a trough light amount of the light outputted by the multiple optical elements.

10. A light amount correcting device as claimed in claim 9, wherein the light amount measuring device comprises:

a light amount measuring unit including:

a light amount sensor to measure the amount of light outputted from the multiple optical elements, and an open slit which defines an area of said light amount sensor for receiving the light from at least one element of said multiple optical elements and which has a length that is at least as long as a length of said at least one optical element in a secondary scanning direction perpendicular to the main scanning direction;

a mechanism to move said light amount sensor forwardly and backwardly along the alignment of optical elements; and a controller to adjust a position of the light amount measuring unit.

11. A light amount correcting device as claimed in claim 10, wherein the length of said open slit is sufficient to cover the two lines of said optical elements.

12. A solid scanning optical writing device comprising:

multiple optical elements which are aligned in a zigzag fashion to form two lines in a main scanning direction, each of said elements being controllable based on image data to write an image; and a light amount measuring unit including:

a light amount sensor to measure an amount of light outputted by said optical elements, and an open slit which defines an area of said light amount sensor for receiving light from at least one element of said multiple optical elements and which has a length that is longer than a length of said at least one element of said multiple optical elements in a secondary scanning direction perpendicular to the main scanning direction.

13. A solid scanning optical writing device as claimed in claim 12, wherein the length of said open slit is sufficient to cover the two lines of said optical elements.

14. A solid scanning optical writing device as claimed in claim 12, further comprising a mechanism for moving said light amount measuring unit forwardly and backwardly along the alignment of the optical elements.

15. A solid scanning optical writing device as claimed in claim 12, further comprising a light amount processor for determining a light correction amount based at least in part on a ridge light amount and a trough light amount of light output from said at least one optical element.

* * * * *